United States Patent [19]

Lewis et al.

[11] Patent Number: 4,545,320

[45] Date of Patent: Oct. 8, 1985

[54] FLAG RAISING DEVICE FOR WATER SKIING

[76] Inventors: Brett Lewis, 23203 Faisant Ct., Valencia, Calif. 91355; Van N. Fellner, 12661 Byron Ave., Granada Hills, Calif. 91342

[21] Appl. No.: 532,667

[22] Filed: Sep. 16, 1983

[51] Int. Cl.[4] ..... G09F 17/00

[52] U.S. Cl. ..... 116/28 R; 116/173

[58] Field of Search ..... 40/218; 114/243; 116/28 R, 173–175, 209, 313, 314; 248/514; 441/68, 69, 73, 84, 89; 242/86.5 R, 96, 107, DIG. 34

[56] References Cited

U.S. PATENT DOCUMENTS

| | | | |
|---|---|---|---|
| 562,195 | 6/1896 | Plath | 248/514 |
| 2,959,414 | 11/1960 | Saltz | 242/107 |
| 3,079,885 | 3/1963 | Cooke | 441/69 |
| 3,109,075 | 10/1963 | Ratcliff | 441/69 |
| 3,213,823 | 10/1965 | Levy et al. | 116/173 |
| 3,520,273 | 7/1970 | Daifotes | 116/28 R |
| 3,602,188 | 8/1971 | Penaflor | 116/313 |
| 3,735,724 | 5/1973 | Miller | 116/303 |
| 3,786,778 | 1/1974 | Palmer et al. | 116/313 |
| 4,122,796 | 10/1978 | Pressler et al. | 116/313 |
| 4,416,429 | 11/1983 | Jessamine | 242/86.5 A |

*Primary Examiner*—Charles Frankfort
*Assistant Examiner*—W. Morris Worth
*Attorney, Agent, or Firm*—Charmasson & Holz

[57] ABSTRACT

A device for raising a warning flag in the rear of a boat pulling a water skier if the skier falls, is disclosed. The device comprises a pivot member in which the flag pole is mounted and which is spring biased towards a position in which the flag pole is vertical. A retaining device normally holds the pivot member in a position in which the flag pole is lowered. When the skier falls the retaining device is released either manually or automatically to allow the pivot member to move under the spring-bias to raise the flag pole.

4 Claims, 4 Drawing Figures

FLAG RAISING DEVICE FOR WATER SKIING

BACKGROUND OF THE INVENTION

The present invention relates to a device for raising flags in boats, particularly in boats used to pull water-skiers.

In water-skiing, a spotter, riding in the towing boat is required to hold a warning flag whenever the skier falls. This serves as a warning to all other boats in the vicinity that there is someone in the water.

Previously the warning flag in ski-boats has been held or raised manually. This means that the spotter on the boat must shift his attention from the fallen skier, to turn around and look for the flag, and then hold it up or insert it in a slot provided for that purpose in the rear of the boat. This is clearly inconvenient for the spotter and results in some time delay between the skier falling and the warning flag being raised. There is also some risk that the spotter will lose sight of the skier, which often occurs in crowded lakes or waterways.

SUMMARY OF THE INVENTION

It is an object of the present invention to provide a device for raising a flag in the rear of a boat quickly and easily.

The flag-raising device according to the invention comprises a flag pole mounted in pivot means so as to be rotatable between a lowered, generally horizontal position and a raised, generally vertical position. Bias means are provided for urging the flag pole towards its raised position, and releasable retaining means normally hold the flag pole in its lowered position.

In one embodiment of the invention the retaining means are released manually by the driver of the boat so as to raise the flag pole when a skier falls. The retaining means may, for example, comprise a pin engaging in the pivot means to prevent rotation. When the flag is to be raised, the pin is pulled out and the bias means urges the flag pole into the vertical position.

In another embodiment of the invention, the flag-raising is completely automatic. In this embodiment the retaining means is provided by the tension in the rope pulling the water skier. This prevents rotation of the pivot means and holds the flag pole in the lowered position. If the skier falls, the tension is released and the bias means acts to raise the flag pole.

Thus in the second embodiment the driver of the boat does not have to worry about raising the warning flag before circling back to pick up the water skier. In the first embodiment the driver simply reaches back and pulls out a release pin to raise the flag, entailing little or no delay before he can concentrate on picking up the skier.

The bias means is preferably a spring acting between the pivot means and a fixed housing for the pivot means. The device is designed to be easily mounted on the rear of a ski-boat or any other boat where a warning flag is required.

The present invention therefore provides a quick and easy way to raise a warning flag in water-skiing.

BRIEF DESCRIPTION OF THE DRAWINGS

The following is a brief description of the accompanying drawings which show some preferred embodiments of the invention.

BRIEF DESCRIPTION OF THE PREFERRED EMBODIMENT OF THE INVENTION

Figure 1:
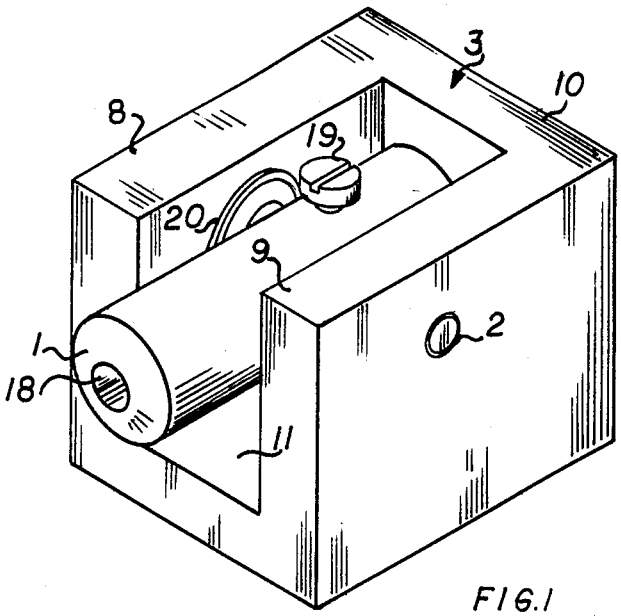
FIG. 1 is an isometricle view of a first embodiment of the flag-raising device according to the invention.
Figure 2:
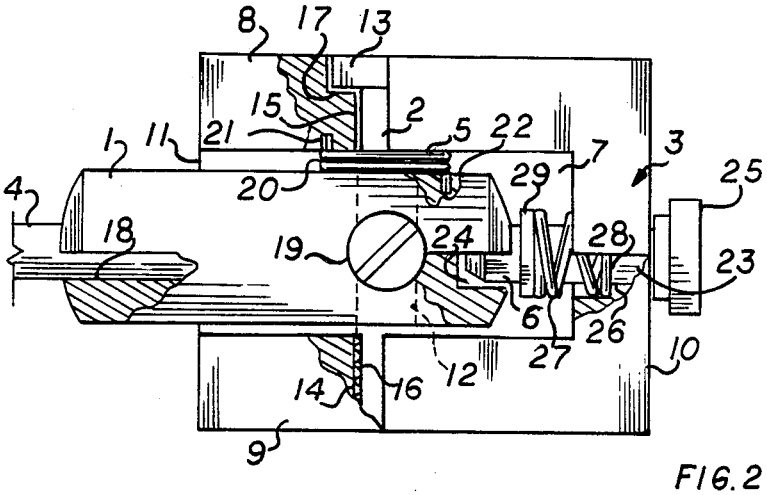
FIG. 2 is a top plan view, partially in section, of the device shown in FIG. 1.

FIGS. 1 and 2 show a first embodiment of the flag-raising device according to the invention. The device shown in FIG. 1 and 2 comprises a pivot arm 1 mounted on a pivot pin 2 in a housing 3 which may be secured to the rear end of a boat by suitable means (not shown). A flag pole 4 is secured in the free end of pivot arm 1, as shown in FIG. 2, and the pivot arm 1 and flag pole 4 are rotatable between the lowered, generally horizontal position shown in the drawings and a raised, vertical position. The pivot arm 1 is biased towards the raised position by means of a biasing device 5 and is normally held in the lowered position by means of a releasable retaining device 6, as described in more detail below.

The pivot arm 1 is mounted in an elongate slot 7 defined in the housing 3 between side walls 8 and 9 and end wall 10. The slot is open at one end 11 and the pivot arm 1 and flag pole 4 extend out of the open end 11 when in the lowered position shown. The open end 11 is arranged to face away from the boat when the device is mounted, so the flag pole 4 and flag will trail behind the boat when in the lowered position.

The pivot pin 2 extends across the slot 7 between side walls 8 and 9 and through a transverse bore 12 in pivot arm 1. The pivot arm 1 is therefore rotatable about the axis of pin 2. The pivot pin 2 has a head 13 at one end and is screw-threaded at the opposite end 14. This pin 2 extends through opposed bores 15 and 16 in the side walls 8 and 9, respectively, with the headed end engaging in a corresponding recess 17 in bore 15. The screw-threaded end 14 engages corresponding threads in bore 16 to hold the pin 2 in place.

The pivot arm 1 is a generally cylindrical member and has an axial bore 18 at its fore end in which the flag pole 4 is mounted. The flag pole 4 is releasably secured in the bore 18 by means of a retaining bolt 19 in this embodiment. It may alternatively be secured by ay other suitable means or may be governed itegrally with the pivot arm. In the embodiment shown the flag pole can be removed and replaced if necessary.

The biasing device 5 comprises a coil spring 20 acting between the side wall 8 of the housing 3 and the pivot arm 1 so as to urge the pivot arm 1 towards an upright position. The spring 20 engages at one end in a recess 21 in side wall 8 and at the other end in a recess 22 in the pivot arm 1.

The retaining device 6 comprises a locking pin 23 releasably engaged in a corresponding recess 24 in the inner end of pivot arm 1. The locking pin 23 has a head 25 for manual operation at one end. The other end of pin 23 extends through a bore 25 in end wall 10 and into the slot 7 to engage in recess 24. The locking pin 23 is normally held in locking engagement with recess 24 by the action of a spring 27 acting between a shoulder 28 in the bore 26 and a collar 29 on the pin 23, as seen in FIG. 2.

When the locking pin 23 engages in the recess 24 in pivot arm 1 as shown in FIG. 2, the pivot arm 1 is prevented from rotating about pivot pin 2 and the flag pole is held in a lowered position. If a user of the device, for example the driver of the ski-boat, wishes to raise the warning flag, he simply turns around and pulls the head 25 of locking pin 23 towards him until pivot arm 1 is released. The action of the spring 20 then urges the pivot arm 1 to rotate upwards until the flag pole 4 is substantially vertical. In this position the pivot arm 1 and flag pole 4 extend upwardly out of the upper face of the slot 7. The warning flag is then raised and clearly visible to people in the vicinity.

When the flag is to be lowered, the user simply pushes the flag pole 4 and pivot arm 1 down until the lowered position is reached. At this point the locking pin 6 is aligned with the recess 24 in the pivot arm 1 and moves automatically back into locking engagement with the recess under the action of the spring 27.

Figure 3:
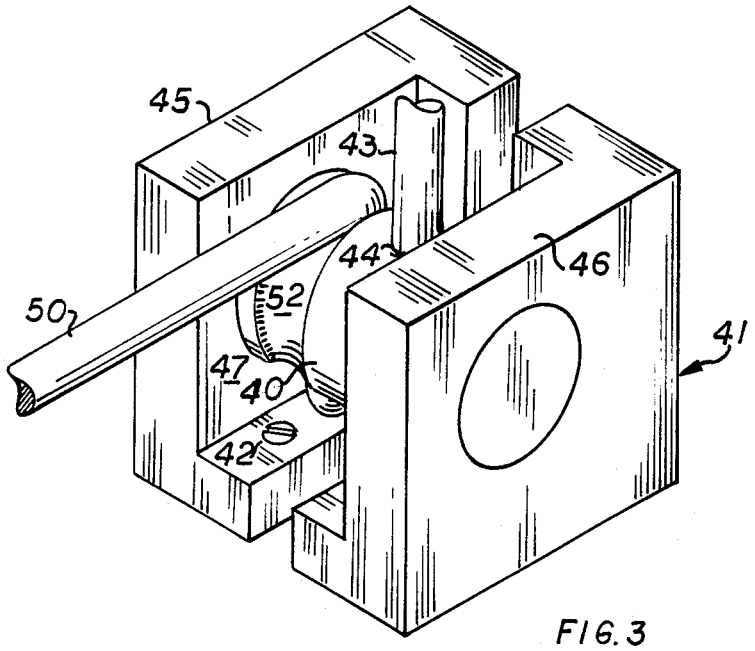
FIG. 3 is an isometricle view of a second embodiment of the flag-raising device according to the invention, showing the flag pole in its raised position.
Figure 4:
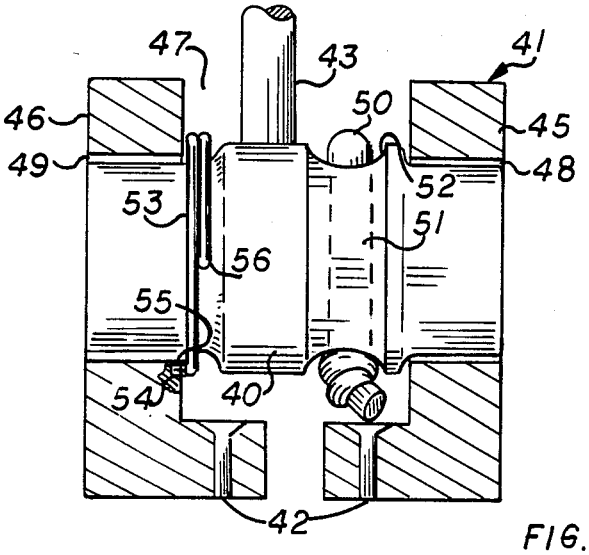
FIG. 4 is a rear end view, partially in section, of the device shown in FIG. 3.

A second embodiment of the invention is shown in FIGS. 3 and 4. In this embodiment the flag is raised and lowered completely automatically.

The device shown in FIGS. 3 and 4 comprises a generally cylindrical pivot member 40 rotatably mounted in a two part housing 41 which can be mounted on the rear of a boat with bolts 42. A flag pole 43 is mounted in a radial bore 44 in pivot member 40.

The two part housing 41 comprises side walls 45 and 46 which face each other to define an indented recess 47 in which the pivot members 40 is mounted. Opposite ends of the pivot member 40 are rotatably mounted in opposed bores 48 and 49 in the side walls 45 and 46, respectively.

A tether rope 50 for a water skier is attached to the cylindrical pivot member 40 via a transverse bore 51 extending through the pivot member. The arrangement is such that force applied to the tether rope during water skiing will cause the pivot member 40 to rotate until the flag pole 43 is lowered. A circumferential groove 52 is provided in the vicinity of bore 51 for maintaining the rope 50 in a fixed position on pivot member 40.

A biassing spring 53 is provided for urging the pivot member 40 to rotate into a position in which the flag pole is raised. The spring 53 acts between the side wall 46 and the pivot member 40, as shown in FIG. 4. One end 54 of the spring is located in a recess 55 in the side wall 46 and the other end 56 is mounted in a recess (not visible) in pivot member 40.

When the tether rope 50 is used to pull a water skier from the rear of a boat, the tension in the rope will rotate the pivot member about its axis until the rope extends substantially horizontally out of the rear of the boat and the flag pole is lowered. Clearly the orientation of the bore 51 for securing the tether rope 50 will determine how far the pivot member is rotated. In the embodiment shown the bore 51 extends parallel to the flag pole 43, so the pivot member will be rotated approximately 90° until the bore 51 and flag pole 43 are substantially horizontal. However, the bore 51 may be at any inclination which will allow the flag pole to be lowered sufficiently when tension is applied to the rope 50. Thus the tension in the rope 50 acts to normally retain the flag and flag pole in a lowered position during water skiing.

If the water skier falls, the tension in the tether rope 50 will be released and the spring 53 will act to urge the pivot member to rotate until the flag pole 43 is in the raised position shown in the drawings. Thus the warning flag is raised automatically whenever the water skier falls.

In both of the embodiments described above, operative parts of the flag raising device may be of plastic or any other suitable material.

The flag raising devices shown in the above embodiments allow a warning flag to be raised simply and quickly, and they are relatively inexpensive and easy to manufacture and install on any boat.

It will be clear that modifications can be made to the disclosed embodiment without departing from the scope of the invention, and the invention is therefore not limited to the disclosed embodiment but is defined by the appended claims.

What is claimed is:

1. A flag raising device for a water skier's towing boat, the device comprising:

a housing adapted to be mounted on the rear of a boat;

said housing having a slot open at one end;

a pivot pin;

a generally cylindrical pivot arm which is pivotally mounted at one end in said slot on said pivot pin;

said pivot pin passing through a diametric bore in said pivot arm and extending transversely across said slot;

said pivot arm extending out of said slot and being rotatable between a raised, generally vertical position and a lowered position;

said pivot arm having a first axial bore in said one end, and a second axial bore in the opposite end;

a flag pole;

said flag pole mounted in said second axial bore;

spring bias means acting between said housing and said pivot arm for urging said pivot arm towards said raised position; and a locking pin for normally holding said pivot arm in said lowered position;

said locking pin movable normally between a locking positon in which it is in locking engagement in said first axial bore so as to hold said pivot arm against rotation from said lowered position, and a released position in which said first axial bore is disengaged and pivot arm is free to rotate to said raised position.

2. The device of claim 1, in which said locking pin is spring-loaded towards said locking position.

3. A flag raising device for a water skier's towing boat, the device comprising:

a flag pole;

a housing adapted to be mounted on the rear of a boat;

said housing having opposed side walls defining a recess facing away from said boat, each side wall having a bore which is opposite and coaxial to a bore on the other wall;

a cylindrical pivot member rotatably and axially mounted at opposite ends in said opposed coaxial bores;

said pivot member having a radially-directed recess in which said flag pole is mounted, said radially-directed recess positioned such that said flag pole may swing through an arc from a substantially vertical first position to a substantially horizontal second position;

said pivot member also having a transverse bore extending through said pivot member and through which a rope for towing a water skier can be secured, such that when generally horizontal tension is applied to said rope, said pivot member is rotated so that said flag pole stops at said second position; and spring bias means acting between said housing and said pivot member to urge said pivot member to said first position when the tension on said rope is released.

4. A flag-raising device for a water skier's towing boat, the device comprising:

a housing for mounting on the rear of the boat, the housing defining a recess facing away from said boat;

a generally cylindrical pivot member pivotally mounted across said recess so as to be axially rotatable;

said pivot member having a diametric transverse bore through which one end of a rope for towing said skier is secured, and a radial bore spaced from and substantially parallel to said transverse bore;

a flag pole mounted in said radial bore in said pivot member so as to be rotatable with said pivot member from a raised, generally vertical position to a lowered position in which said pole projects away from said boat when tension is applied to said rope in a generally horizontal direction; and spring bias means acting between said housing and said pivot member for urging said pivot member to rotate said flag pole into said raised position when tension on said rope is released, means for securing a tow rope for a water skier to said pivot member such that tension applied to said rope in a generally horizontal, rear-facing direction will rotate said pivot member until said flag pole is in said lowered position, said bias means acting to urge said flag pole into said raised position on release of tension in said rope.

* * * * *